US011303056B2

(12) United States Patent
Huang et al.

(10) Patent No.: US 11,303,056 B2
(45) Date of Patent: Apr. 12, 2022

(54) TERMINAL ASSEMBLY AND CONNECTOR

(71) Applicant: Dongguan Luxshare Technologies Co., Ltd, Dongguan (CN)

(72) Inventors: Bin Huang, Dongguan (CN); RongZhe Guo, Dongguan (CN); ChenHui Zeng, Dongguan (CN); HongJi Chen, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 0 days.

(21) Appl. No.: 17/002,079

(22) Filed: Aug. 25, 2020

(65) Prior Publication Data

US 2021/0313726 A1 Oct. 7, 2021

(30) Foreign Application Priority Data

Apr. 7, 2020 (CN) ..... 202010266920.3

(51) Int. Cl.

| | |
|---|---|
| ***H01R 13/24*** | (2006.01) |
| ***H01R 13/40*** | (2006.01) |
| ***H01R 13/502*** | (2006.01) |
| ***H01R 43/20*** | (2006.01) |

(52) U.S. Cl.

CPC ..... *H01R 13/2407* (2013.01); *H01R 13/2464* (2013.01); *H01R 13/40* (2013.01); *H01R 13/502* (2013.01); *H01R 43/20* (2013.01)

(58) Field of Classification Search

CPC ..... H01R 13/2407; H01R 13/2464; H01R 13/40; H01R 13/502; H01R 13/20

See application file for complete search history.

(56) References Cited

U.S. PATENT DOCUMENTS

| | | | | |
|---|---|---|---|---|
| 8,992,262 | B2 * | 3/2015 | Pang | H01R 13/6471 439/626 |
| 9,543,688 | B2 * | 1/2017 | Pao | H01R 13/6587 |
| 10,050,369 | B1 * | 8/2018 | Yang | H01R 13/405 |
| 10,594,065 | B2 * | 3/2020 | Toh | H01R 13/405 |

(Continued)

FOREIGN PATENT DOCUMENTS

| | | |
|---|---|---|
| CN | 101465490 A | 6/2009 |
| CN | 202797488 U | 3/2013 |

(Continued)

*Primary Examiner* — Abdullah A Riyami

*Assistant Examiner* — Nader J Alhawamdeh

(74) *Attorney, Agent, or Firm* — Birch, Stewart, Kolasch & Birch, LLP

(57) ABSTRACT

The present disclosure provides a terminal assembly comprising a first terminal component and a second terminal component. The first terminal component comprises a plurality of first terminals, each of the first terminals comprises a first terminal body and a first plug end part disposed on one end of the first terminal body. The first plug end part comprises a first plug elastic sheet and a first extension protector. The first plug elastic sheet comprises a first plug end, a first connecting end and a first contacting bump. The first connecting end is connected to the first terminal body. The first contacting bump is disposed between the first plug end and the first connecting end. The first extension protector is disposed on the first plug end of the first plug elastic sheet.

17 Claims, 8 Drawing Sheets

(56) References Cited

U.S. PATENT DOCUMENTS

| | | | | |
|---|---|---|---|---|
| 10,950,961 | B2 * | 3/2021 | Lai | H01R 13/40 |
| 10,998,679 | B2 * | 5/2021 | Long | H01R 13/6477 |
| 2004/0224567 | A1 * | 11/2004 | Zhong | H01R 12/721 439/701 |
| 2012/0083163 | A1 | 4/2012 | Lee et al. | |
| 2014/0094064 | A1 * | 4/2014 | Tsai | H01R 12/721 439/630 |
| 2016/0079709 | A1 * | 3/2016 | Su | H01R 13/6477 439/660 |
| 2016/0352040 | A1 * | 12/2016 | Pao | H01R 13/6587 |
| 2019/0097336 | A1 * | 3/2019 | Toh | H01R 12/721 |
| 2020/0328541 | A1 * | 10/2020 | Lai | H01R 12/716 |
| 2021/0075164 | A1 * | 3/2021 | Chen | H01R 13/2464 |
| 2021/0135389 | A1 * | 5/2021 | Jiang | H01R 43/20 |

FOREIGN PATENT DOCUMENTS

| | | | |
|---|---|---|---|
| CN | 104218350 | A | 12/2014 |
| CN | 106997992 | A | 8/2017 |
| CN | 209389289 | U | 9/2019 |
| TW | M563095 | U | 7/2018 |

* cited by examiner

TERMINAL ASSEMBLY AND CONNECTOR

CROSS REFERENCE TO RELATED APPLICATION

This application claims the priority benefit of Chinese Patent Application Serial Number CN202010266920.3, filed on Apr. 7, 2020, the full disclosure of which is incorporated herein by reference.

BACKGROUND

Technical Field

The present disclosure relates to the technical field of the connector, particularly to a terminal assembly and a connector.

Related Art

The design of conventional connectors places great emphasis on SI performance. The test data of the SI performance of the connector includes the characteristic impedance, insertion loss and return loss, near-end crosstalk and far-end crosstalk of the connector. The terminal of the conventional connector comprises a terminal body and plug end part comprising contacting bump for contacting the goldfingers of the plugging plate. The length of one end of the plug end part away from the terminal body contacting the contacting bump would affect the SI performance of the connector.

SUMMARY

The embodiments of the present disclosure provide a terminal assembly and a connector to solve the problem that the SI performance is affected by the length of the plug end part of the conventional connector.

On the first aspect, the present disclosure provides a terminal assembly comprising a first terminal component and a second terminal component. The first terminal component comprises a plurality of first terminals, each of the first terminals comprises a first terminal body and a first plug end part disposed on one end of the first terminal body. The first plug end part comprises a first plug elastic sheet and a first extension protector. The first plug elastic sheet comprises a first plug end, a first connecting end and a first contacting bump. The first connecting end is connected to the first terminal body. The first contacting bump is disposed between the first plug end and the first connecting end. The first extension protector is disposed on the first plug end of the first plug elastic sheet. The second terminal component is disposed on one side of the first terminal component. The second terminal component comprises a plurality of second terminals, each of the second terminals comprising a second terminal body and a second plug end part disposed on one end of the second terminal body. The second plug end part is opposite to the first plug end part. The second plug end part comprises a second plug elastic sheet and a second extension protector. The second plug elastic sheet comprises a second plug end, a second connecting end and a second contacting bump. The second connecting end is connected to the second terminal body. The second contacting bump is disposed between the second plug end and the second connecting end. The second contacting bump is opposite to the first contacting bump. The second extension protector is disposed on the second plug end. The first plug elastic sheet between the first connecting end and the first contacting bump extends in a direction closing to the second plug end. The first extension protector extends in a direction away from the second plug end part. The second plug elastic sheet between the second connecting end and the second contacting bump extends in a direction closing to the first plug end part. The second extension protector extends in a direction away from the first plug end part.

On the second aspect, the present disclosure provides a terminal assembly comprising a first terminal component comprising a plurality of first terminals, each of the first terminals comprising a first terminal body and a first plug end part disposed on one end of the first terminal body. The first plug end part comprises a first plug elastic sheet and a first extension protector. The first plug elastic sheet comprises a first plug end, a first connecting end and a first contacting bump. The first connecting end is connected to the first terminal body. The first contacting bump is disposed between the first plug end and the first connecting end. The first extension protector is disposed on the first plug end of the first plug elastic sheet.

On the third aspect, the present disclosure provides a connector comprising a base, a housing and a first terminal component according to the first aspect. The housing is disposed on one side of the base, comprising a terminal plug slot and a terminal accommodating slot communicating with the terminal plug slot. The terminal plug slot comprises a plug opening and a plurality of terminal positioning slots disposed on an upper sidewall and a lower sidewall of the terminal plug slot. The plurality of terminal positioning slots is close to the plug opening. The first terminal component is disposed in the terminal plug slot and the terminal accommodating slot. Each of the first plug end parts and each of the second plug end parts are disposed in the terminal plug slot. Each of the first extension protectors and each of the second extension protectors are disposed in the plurality of terminal positioning slots.

In the embodiments of the present disclosure, the SI performance of the connector can be improved by shortening the first plug end of the first plug elastic sheet and the second plug end of the second plug elastic sheet of a metal conductor. Meanwhile, a first extension protector as an insulator provided on the first plug end of the first plug elastic sheet and a second extension protector provided on the second plug end of the second plug elastic sheet respectively protect the first plug end and the second plug end to prevent the first plug end and the second plug end from being compressed to deform when the plugging. In this way, the structural strength of the first terminal and the second terminal can be effectively enhanced.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

Figure 1:
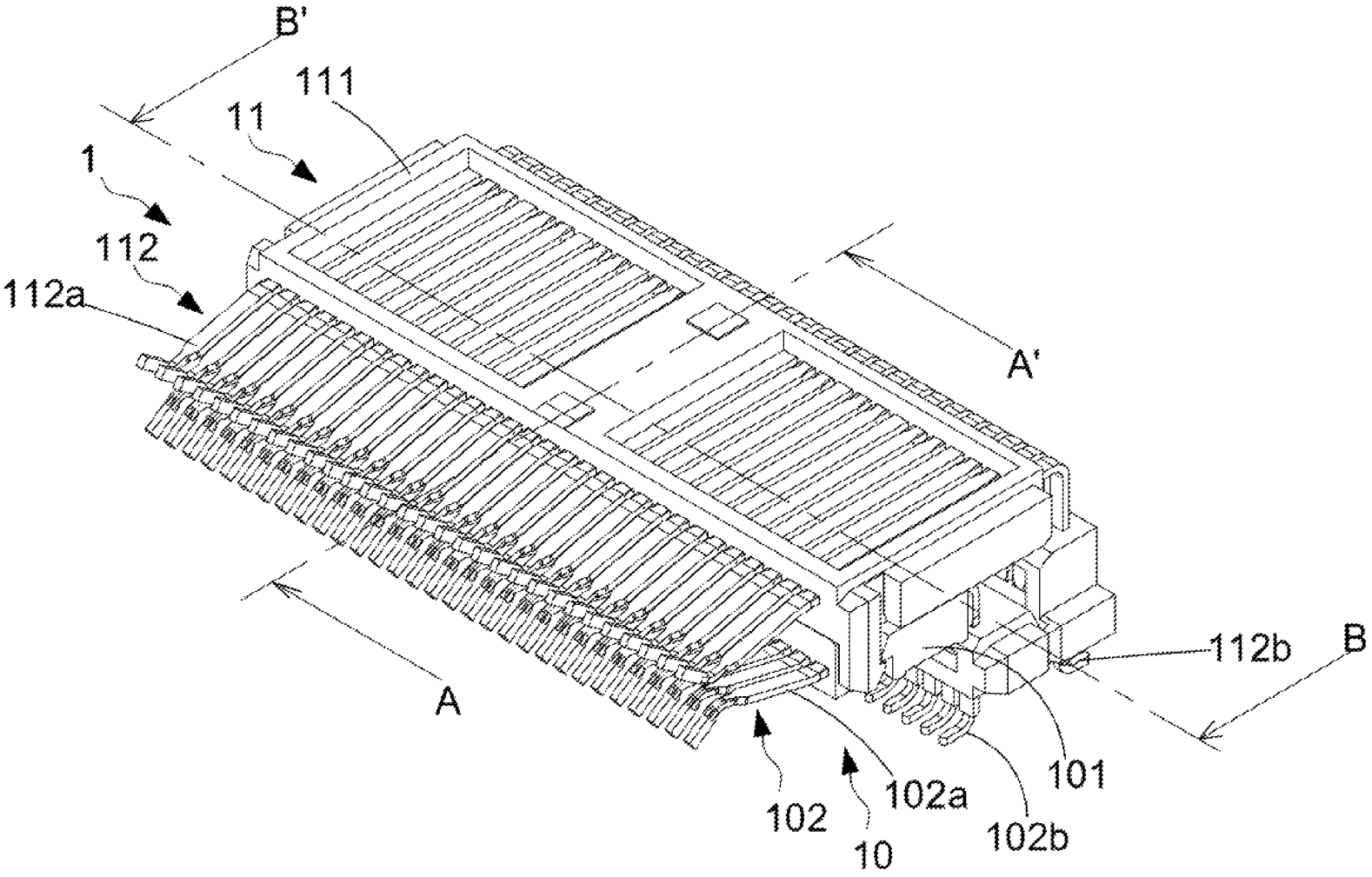
FIG. 1 is a perspective view of a terminal assembly of the first embodiment of the present disclosure.

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

In the following embodiment, the same reference numerals are used to refer to the same or similar elements throughout the disclosure.

Figure 2:
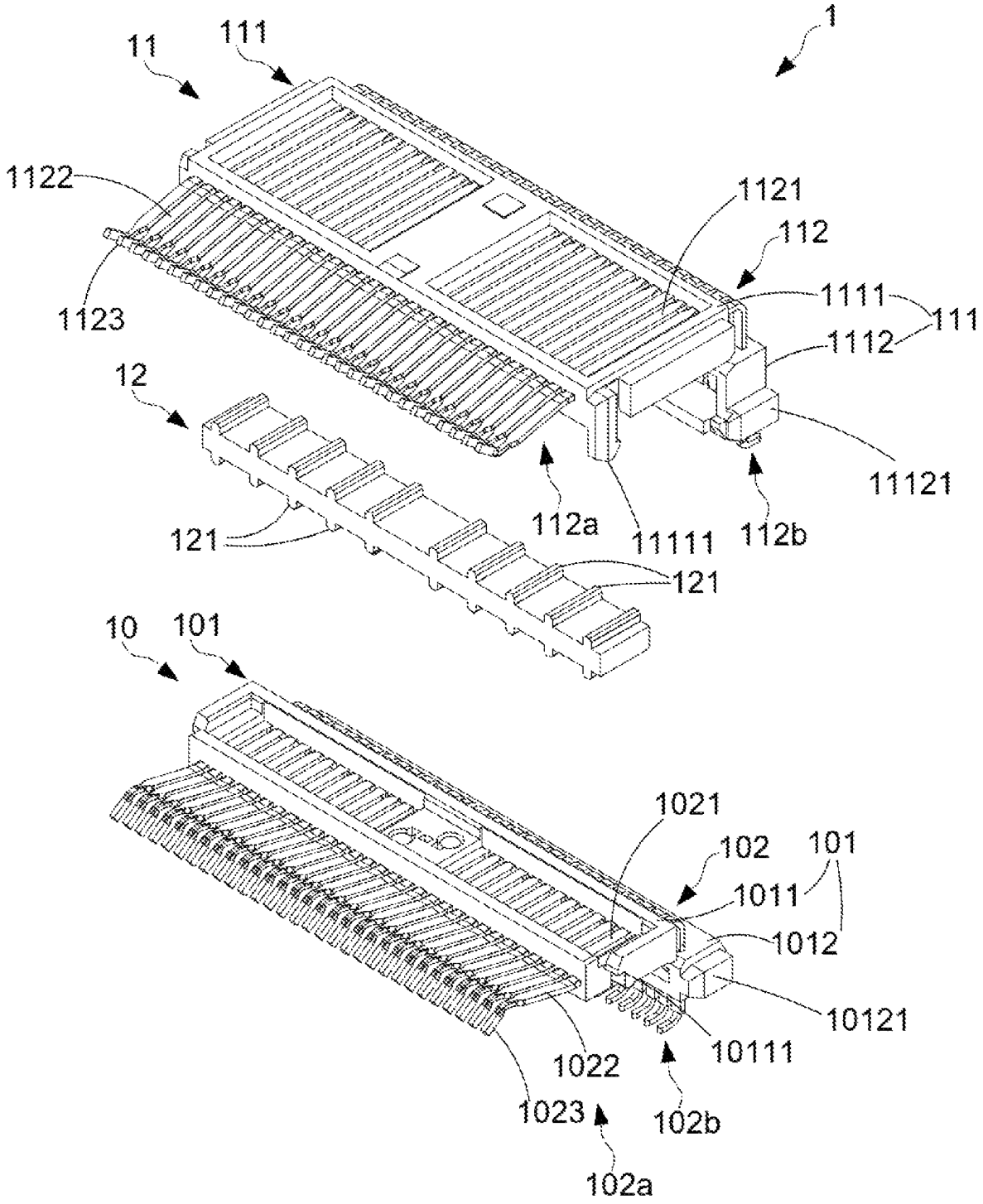
FIG. 2 is an exploded view of the terminal assembly of the first embodiment of the present disclosure.

FIG. 1 and FIG. 2 are perspective view and exploded view of a terminal assembly of the first embodiment of the present disclosure. As shown in the figures, terminal assembly 1 of this embodiment comprises a first terminal component 10 and a second terminal component 11 disposed on one side of the first terminal component 10. The first terminal component 10 comprises a first insulating body 101 and a plurality of first terminals 102 disposed in the first insulating body 101. In this embodiment, the first insulating body 101 is inject-molded onto the plurality of first terminals 102. Each of the first terminal 102 comprises a first terminal body 1021, a first plug end part 102*a*, and a first connecting end part 102*b*. The first plug end part 102*a* and the first connecting end part 102*b* are respectively disposed on two ends of the first terminal body 1021. The first insulating body 101 is disposed on the first terminal body 1021. The first plug end part 102*a* protrudes from one side of the first insulating body 101. The first connecting end part 102*b* protrudes from the other side of the first insulating body 101. In this embodiment, the extending direction of the first plug end part 102*a* is orthogonal to the extending direction of the first connecting end part 102*b*.

Similarly, the second terminal component 11 comprises a second insulating body 111 and a plurality of second terminals 112 disposed in the second insulating body 111. In this embodiment, the second insulating body 111 is inject-molded onto the plurality of second terminals 112. Each of the second terminal 112 comprises a second terminal body 1121, a second plug end part 112*a*, and a second connecting end part 112*b*. The second insulating body 111 is disposed on the second terminal body 1121. The second plug end part 112*a* protrudes from one side of the second insulating body 111. The second connecting end part 112*b* protrudes from the other side of the second insulating body 111. In this embodiment, the extending direction of the second plug end part 112*a* is orthogonal to the extending direction of the second connecting end part 112*b*. When the second terminal component 11 is provided on the first terminal component 10, the second insulating body 111 is connected to the first insulating body 101, the first plug end part 102*a* is opposite to the second plug end part 112*a*, and the first connecting end part 102*b* is opposite to the second connecting end part 112*b*.

Figure 3:
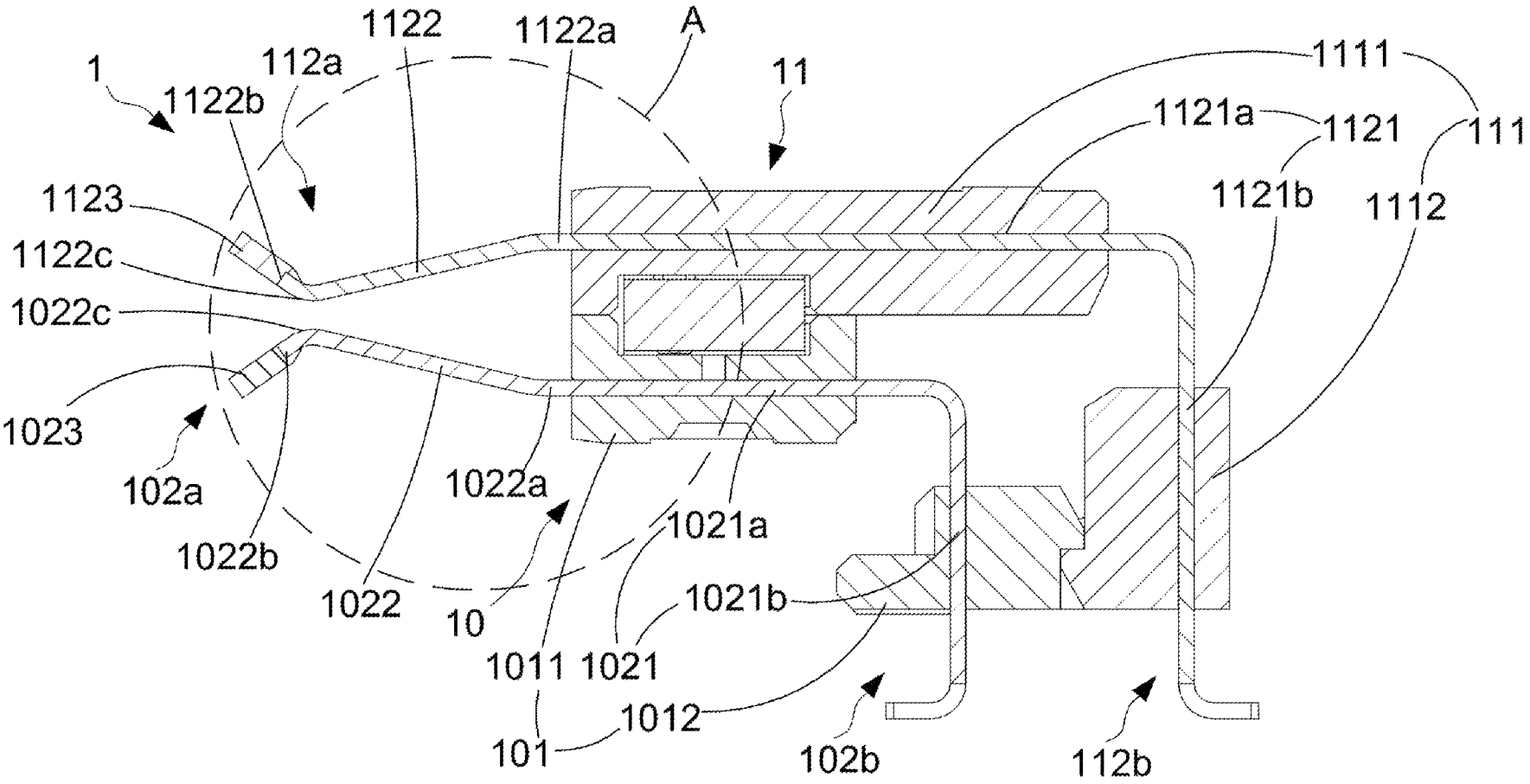
FIG. 3 is a cross-sectional view along line A-A' of FIG. 1.
Figure 4:
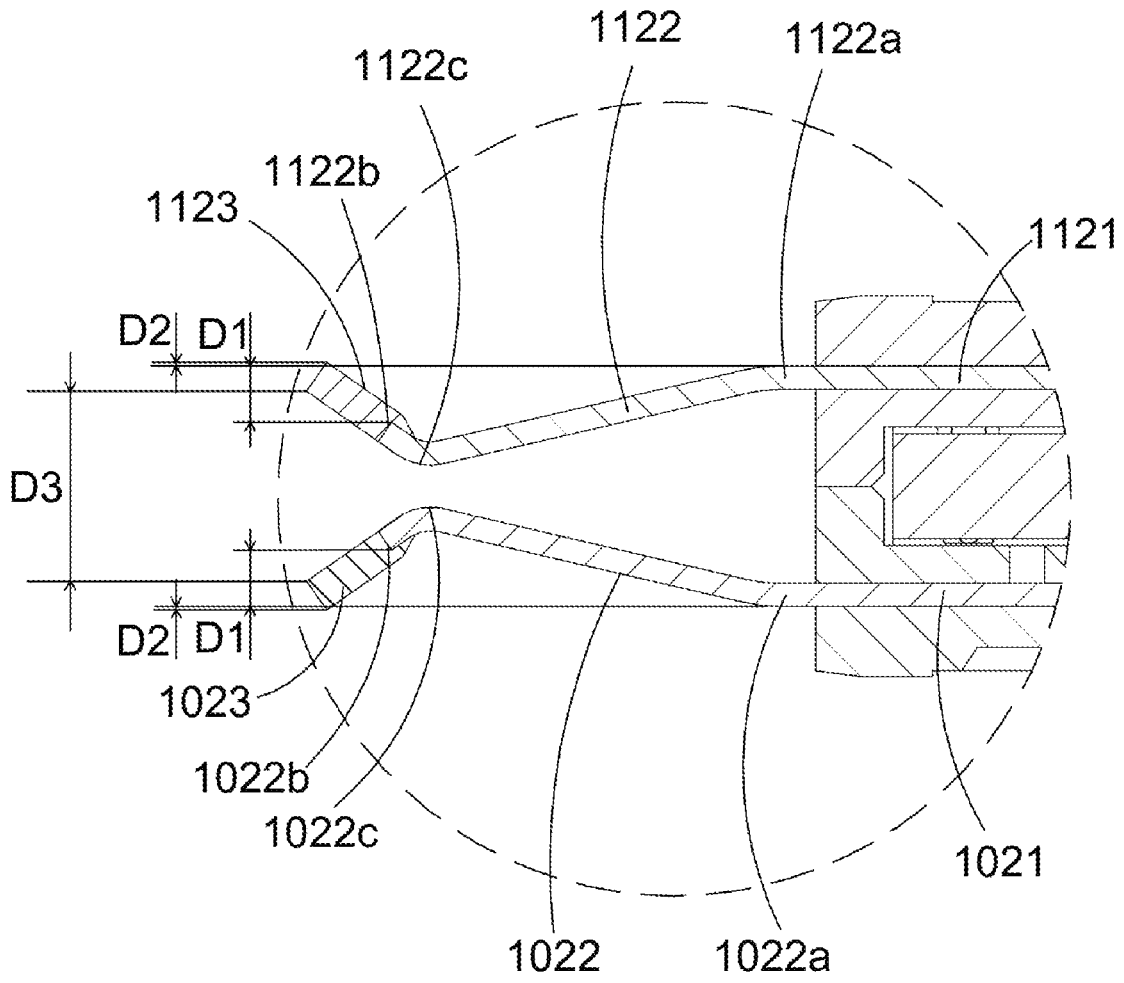
FIG. 4 is an enlarged view of area A of FIG. 3.

FIG. 3 is a cross-sectional view along line A-A' of FIG. 1. FIG. 4 is an enlarged view of area A of FIG. 3. As shown in the figures, the first plug end part 102*a* comprises a first plug elastic sheet 1022 and a first extension protector 1023. The first plug elastic sheet 1022 comprises a first connecting end 1022*a*, a first plug end 1022*b*, and a first contacting bump 1022*c*. The first connecting end 1022*a* of the first plug elastic sheet 1022 is connected to one end of the first terminal body 1021. The first contacting bump 1022*c* is disposed between the first connecting end 1022*a* and the first plug end 1022*b*. The first plug elastic sheet 1022 between the first connecting end 1022*a* and the first contacting bump 1022*c* extends in a direction toward the second plug end part 112*a*. The first plug elastic sheet 1022 between the first contacting bump 1022*c* and the first plug end 1022*b* extends in a direction away from the second plug end part 112*a*. A first vertical gap D1 exists between the first plug end 1022*b* and the first connecting end 1022*a* of the first plug elastic sheet 1022. The first extension protector 1023 is disposed on the first plug end 1022*b* of the first plug elastic sheet 1022 and covers the first plug end 1022*b* of the first plug elastic sheet 1022, wherein the covering could be fully covering or partially covering. The first extension protector 1023 extends in a direction away from the second plug end part 112*a*. That is, the extending direction of the first extension protector 1023 is the same as the extending direction of the first plug end 1022*b*. A second vertical gap D2 exists between one end of the first extension protector 1023 away from the first plug end 1022*b* and the first connecting end 1022*a*. The first vertical gap D1 is greater than the second vertical gap D2. In this embodiment, one end of the first extension protector 1023 away from the first plug end 1022*b* and a surface of the first terminal body 1021 away from the second terminal body 1121 are substantially in the same level of a horizontal plane, which indicates that the second vertical gap D2 is basically equal to zero.

Similarly, the second plug end 112*a* comprises a second plug elastic sheet 1122 and a second extension protector 1123. The second plug elastic sheet 1122 comprises a second connecting end 1122*a*, a second plug end 1122*b* and a second contacting bump 1122*c*. The second connecting end 1122*a* of the second plug elastic sheet 1122 is connected to one end of the second terminal body 1121. The second contacting bump 1122*c* is disposed between the second connecting end 1122*a* and the second plug end 1122*b*. The second plug elastic sheet 1122 between the second connecting end 1122*a* and the second contacting bump 1122*c* extends in a direction toward the first plug end part 102*a*. The second plug elastic sheet 1122 between the second contacting bump 1122*c* and the second plug end 1122*b* extends in a direction away from the first plug end part 102*a*. A first vertical gap D1 exists between the second plug end 1122*b* and the second connecting end 1122*a* of the second plug elastic sheet 1122. The second extension protector 1123 is disposed on the second plug end 1122*b* of the second plug elastic sheet 1122, and covers the second plug end 1122*b* of the second plug elastic sheet 1122, wherein the covering could be fully covering or partially covering. The second extension protector 1123 extends in a direction away from the first plug end part 102*a*. That is, the extending direction of the second extension protector 1123 is the same as the extending direction of the second plug end 1022*b*. A second vertical gap D2 exists between one end of the second extension protector 1123 away from the second plug end 1122*b* and the second connecting end 1122*a*. The first vertical gap D1 is greater than the second vertical gap D2. In this embodiment, one end of the second extension protector 1123 away from the second plug elastic sheet 1122 and a surface of the second terminal body 1121 away from the first terminal body 1021 are substantially in the same level of a horizontal plane, which indicates that the second vertical gap D2 is basically equal to zero.

The first plug end part 102*a* of each of the first terminals 102 is opposite to the corresponding second plug end part 112*a* of the second terminal 112. The first contacting bump 1022*c* is opposite to the second contacting bump 1122*c*. An external plug board enters the space between the first plug end 1022*b* of the first plug end 102*a* and the second plug end 1122*b* of the second plug end 112*a*, inserting into the space between the first plug end part 102*a* and the second plug end part 112*a*. The first contacting bump 1022*c* and the second contacting bump 1122*c* respectively contact with a plurality of goldfingers on the plugboard. When the external plug board enters the space between the first plug end 1022*b* of the first plug end part 102*a* and the second plug end 1122*b* of the second plug end part 112*a*, the first extension protector 1023 and the second extension protector 1123 protect and allows the plugboard to smoothly enter the space between the first plug end 1022*b* of the first plug end part 102*a* and the second plug end 1122*b* of the second plug end part 112*a*, that is, guiding the plugboard to insert through the tapered opening formed by the first extension protector 1023 and the second extension protector 1123. A third vertical gap D3 exists between one end of the first extension protector 1023 away from the first plug end 1022*b* and one end of the second extension protector 1123 away from the second plug end 1122*b*. The third vertical gap D3 is greater than the thickness of the plugboard, where the plugboard could be disposed in another connector.

By shortening the lengths of the first plug end 1022*b* and the second plug end 1122*b* of this embodiment, the SI performance of the connector having the terminal assembly 1 of this embodiment could be improved. Meanwhile, by extending the lengths of the first plug elastic sheet 1022 and the second plug elastic sheet 1122 through the first extension protector 1023 and the second extension protector 1123, the structural strength of the first plug end 1022*b* of the first plug elastic sheet 1022 and the second plug end 1122*b* of the second plug elastic sheet 1122 could be enhanced. In this way, the deformation of the first plug end 1022*b* of the first plug elastic sheet 1022 and the second plug end 1122*b* of the second plug elastic sheet 1122 can be avoided when plugging and unplugging to smoothly plug and unplug. In this embodiment, the first extension protector 1023 and the second extension protector 1123 are insulators, such as plastic. The first plug end part 102*a*, the first terminal body 1021, the first connecting end part 102*b*, the second plug end part 112*a*, the second terminal body 1121 and the second connecting end part 112*b* are metal conductors. Thus, the first extension protector 1023 and the second extension protector 1123 do not affect the SI performance of the connector using the terminal assembly 1 of this embodiment.

In this embodiment, the first extension protector 1023 is disposed on the first plug end 1022*b* of each of the first terminals 102. The second extension protector 1123 is disposed on the second plug end 1122*b* of each of the second terminals 112. The plurality of first terminals 102 and the plurality of second terminals 112 respectively comprise a plurality of signal terminals and a plurality of ground terminals. In another embodiment, the first extension protector 1023 may be disposed only on the first plug end 1022*b* of each of the first terminals 102 as signal terminal, and the second extension protector 1123 may be disposed only on the second plug end 1122*b* of each of the second terminals 112 as signal terminal. The first vertical gap between the first plug end 1022*b* of each of the first terminals 102 as ground terminal and the first contacting bump 1022*c* is greater than the first vertical gap D1 between the first plug end 1022*b* of each of the first terminals 102 as signal terminal and the first contacting bump 1022*b*. The first vertical gap between the second plug end 1122*b* of each of the second terminals 112 as ground terminal and the second contacting bump 1122*c* is greater than the first vertical gap D1 between the second plug end 1122*b* of each of the second terminals 112 as signal terminal and the second contacting bump 1122*c*. The SI performance of the connector can also be improved by only shortening the lengths of the first plug end 1022*b* of the first terminal 102 as signal terminal and the second plug end 1122*b* of the second terminal 112.

In one embodiment, the thickness between a surface of the first extension protector 1023 of this embodiment close to the second contacting bump 1122*c* and a surface of the first extension protector 1023 away from the second contacting bump 1122*c* is greater than the thickness between the surface of a first plug elastic sheet 1022 close to the second contacting bump 1122*c* and a surface of the first plug elastic sheet 1022 away from the second contacting bump 1122*c*, allowing the first extension protector 1023 to cover the surface of the first plug end 1022*b* close to the second contacting bump 1122*c* and the surface of the first plug end 1022*b* away from the second contacting bump 1122*c*. The thickness between a surface of the second extension protector 1123 close to the first contacting bump 1022*c* and a surface of the second extension protector 1123 away from the first contacting bump 1022*c* is greater than the thickness between a surface of the second plug elastic sheet 1122 close to the first contacting bump 1022*c* and a surface of the second plug elastic sheet 1122 away from the first contacting bump 1022*c*, allowing the second extension protector 1023 to cover the surface of the second plug end 1122*b* close to the first contacting bump 1022*c* and the surface of the second plug end 1122*b* away from the first contacting bump 1022*c*. In this way, the strength of the first extension protector 1023 and the second extension protector 1123 of this embodiment can be increased.

In one embodiment, the width between two side surfaces of the first extension protector 1023 of this embodiment is greater than the width between two side surfaces of the first plug end 1022*b*, allowing the first extension protector 1023 to cover two side surfaces of the first plug end 1022*b*. Similarly, the width between two side surfaces of the second extension protector 1123 is greater than the width between two side surfaces of the second plug end 1122*b*, allowing the second extension protector 1123 to cover two side surfaces of the second plug end 1122*b*. A gap exists between two adjacent first extension protectors 1023, and a gap exists between two adjacent second extension protectors 1123. In this way, it is possible to keep the two adjacent first extension protectors 1023 apart and to keep the two adjacent second extension protectors 1123 apart for an unaffected operation.

In one embodiment, the thickness of one end of the first extension protector 1023 connected to the first plug end 1022*b* is thinner than the thickness of one end of the first extension protector 1023 away from the first plug end 1022*b*. In other words, reducing the thickness of one end of the first extension protector 1023 close to the first contacting bump 1022*c* could prevent the first plug end part 102*a* from touching the other part of the component due to the displacement when inserting the plugboard. Similarly, the thickness of one end of the second extension protector 1123 connected to the second plug end 1122*b* is thinner than the thickness of one end of the second extension protector 1123 away from the second plug end 1122*b*. In other words, reducing the thickness of one end of the second extension protector 1123 close to the second contacting bump 1122*c* could prevent the second plug end part 112*a* from touching the other part of the component due to the displacement when inserting the plugboard. The thicknesses of the first extension protector 1023 and the second extension protector 1123 can be changed according to actual requirements, and are not limited thereto.

The first terminal body 1021 of each of the first terminals 102 of this embodiment comprises a first body end part 1021*a* and a second body end part 1021*b* connected to the first body end part 1021*a*. The first body end part 1021*a* is orthogonal to the second body end part 1021*b*. The first plug end part 102*a* of each of the first terminals 102 is connected to the first body end part 1021*a*. The first plug end part 102*b* of each of the first terminals 102 is connected to the second body end part 1021*b*. The first insulating body 101 comprises a first insulator 1011 and a second insulator 1012. The first insulator 1011 is disposed on one side of the first body end part 1021*a*. The second insulator 1012 is disposed on one side of the second body end part 1021*b*.

Similarly, the second terminal body 1121 of each of the second terminals 112 of this embodiment comprises a third body end part 1121*a* and a fourth body end part 1121*b*. The third body end part 1121*a* is connected to the fourth body end part 1121*b*. The third body end part 1121*a* is orthogonal to the fourth body end part 1121*b*. The second plug end part 112*a* of each of the second terminals 112 is connected to the third body end part 1121*a*. The second plug end part 112*b* of each of the second terminals 112 is connected to the fourth body end part 1121*b*. The second insulating body 111 comprises a third insulator 1111 and a fourth insulator 1112. The third insulator 1111 is disposed on one side of the third body end part 1121*a*. The fourth insulator 1112 is disposed on one side of the fourth body end part 1121*b*.

The third insulator 1111 is connected to the first insulator 1011. The fourth insulator 1112 abuts against the second insulator 1012. The first insulator 1011 comprises a first buckling member 10111 on two sides. The third insulator 1111 comprises a second buckling member 11111 on two sides. The second insulator 1012 comprises an abutting bump 10121 on two sides. The fourth insulator 1112 comprises an abutting member 11121 on two sides. When each of the second buckling members 11111 of the third insulator 1111 is disposed on each of the first buckling members 10111 of the first insulator 1011, the third insulator 1111 would be connected to the first insulator 1011, and each of the abutting members 11121 abuts against the corresponding abutting bump 10121, allowing the fourth insulator 1112 to abut against the second insulator 1012. Thus, through the bending elastic force of the third body end part 1121*a* and the fourth body end part 1121*b*, the third insulator 1111 and the fourth insulator 1112 are pushed to clamp the first insulator 1011 and the second insulator 1012 secured on the first insulating body 101.

Figure 5:
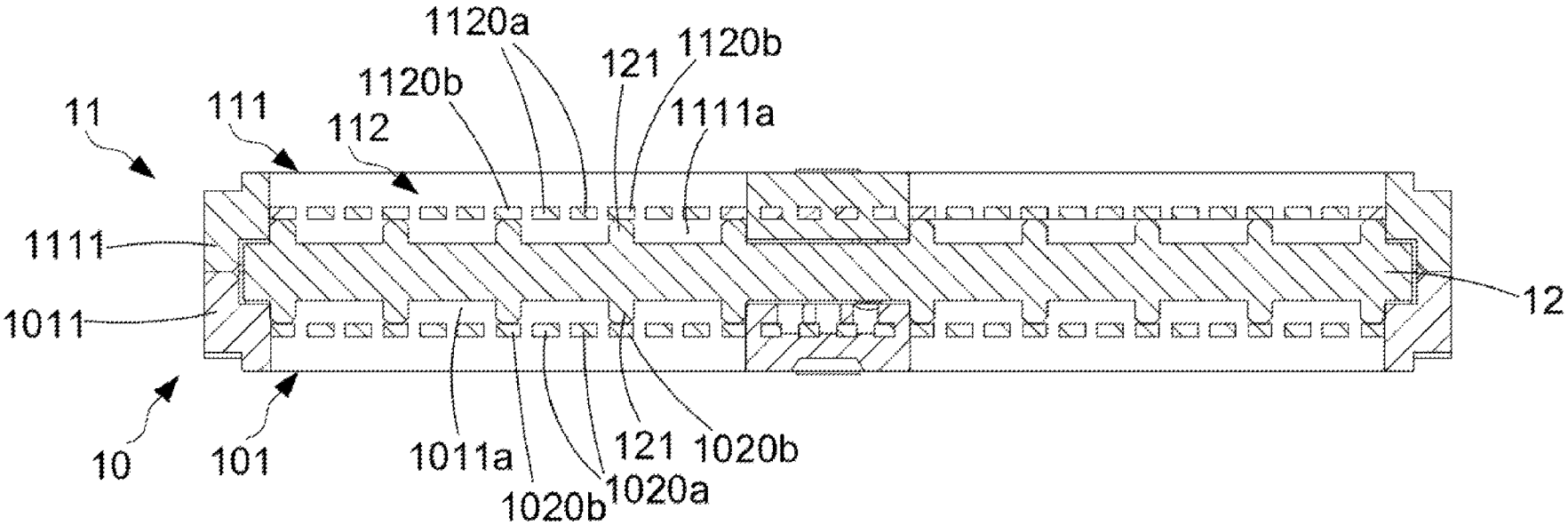
FIG. 5 is a cross-sectional view along line B-B' of FIG. 1.

In one embodiment, FIG. 5 is a cross-sectional view along line B-B' of FIG. 1. As shown in the figure, the plurality of first terminals 102 comprises a plurality of first signal terminals 1020*a* and a plurality of first ground terminals 1020*b*. The plurality of second terminals 112 also comprises a plurality of second signal terminals 1120*a* and a plurality of second ground terminals 1120*b*. The plurality of first signal terminals 1020*a* is opposite to the plurality of second signal terminals 1120*a*. The plurality of first ground terminals 1020*b* is opposite to the plurality of second ground terminals 1120*b*. In this embodiment, the space between two adjacent first ground terminals 1020*b* is provided with two first signal terminals 1020*a*. The space between two adjacent second ground terminals 1120*b* is provided with two second signal terminals 1120*a*. The terminal assembly 1 of this embodiment further comprises a conductive plastic 12 disposed between the first terminal component 10 and the second terminal component 11. The conductive plastic 12 is electrically coupled to the plurality of first ground terminals 1020*b* of the plurality of first terminals 102 and the plurality of second ground terminals 1120*b* of the plurality of second terminals 112. In this way, the conductive plastic 12 can implement electromagnetic shielding and the function of electricity conducting.

In this embodiment, a surface of the first insulator 1011 of the first insulating body 101 close to the second insulating body 111 comprises a first hollow part 1011*a*. The plurality of first terminals 102 is exposed from the first hollow part 1011*a*. Similarly, a surface of the third insulator 1111 of the second insulating body 111 close to the first insulating body 101 comprises a second hollow part 1111*a*. The plurality of second terminals 112 is exposed from the second hollow 1111*a*. The conductive plastic 12 is disposed between the first insulator 1011 and the third insulator 1111 and comprises a plurality of conductive bumps 121. The conductive plastic 12 is disposed between the first insulator 1011 and the third insulator 1111. The plurality of conductive bumps 121 are respectively disposed in the first hollowed part 1011*a* and the second hollowed part 1111*a*, and are electrically coupled to the plurality of first ground terminals 1020*b* and the plurality of second ground terminals 1120*b*.

Figure 6:
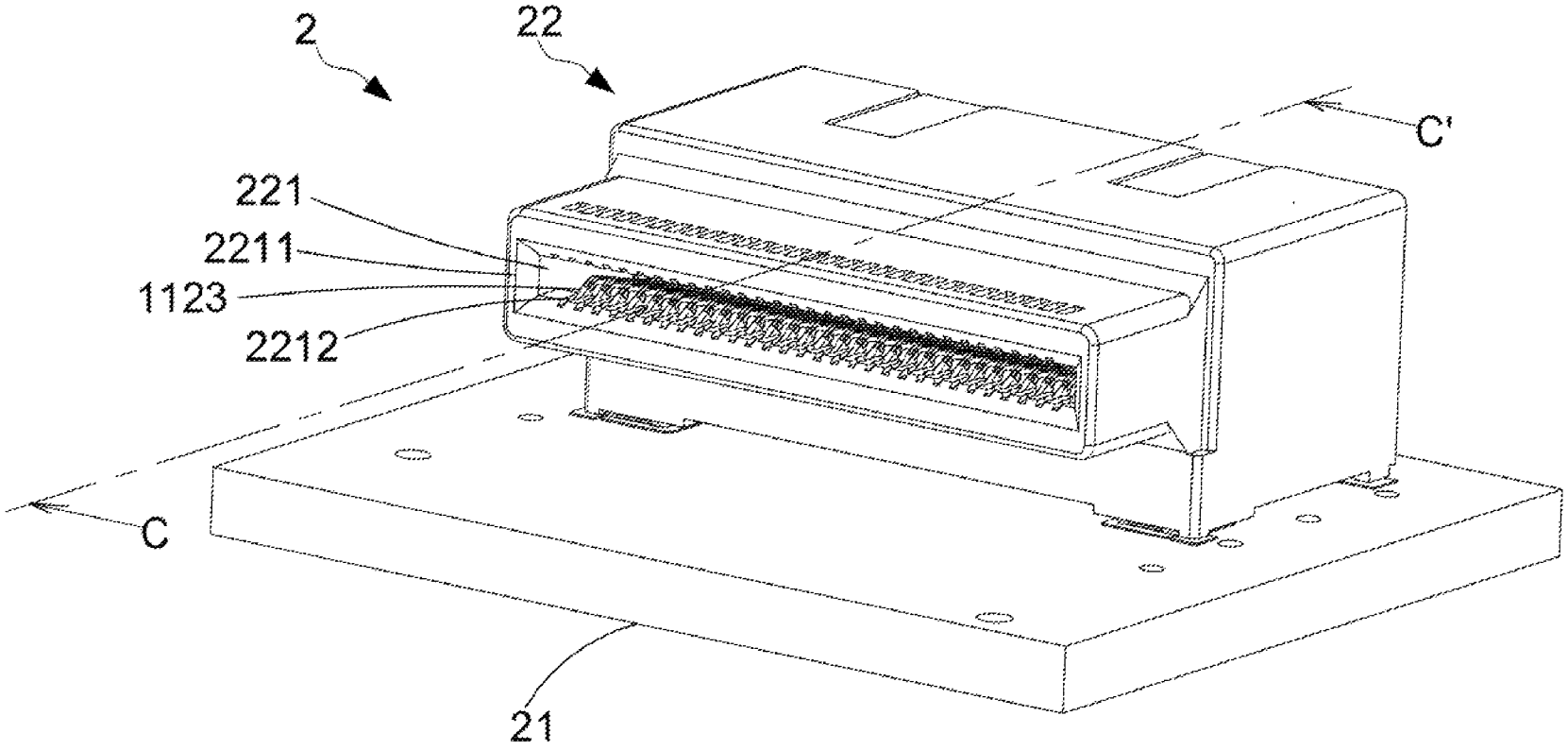
FIG. 6 is a perspective view of a terminal assembly of the second embodiment of the present disclosure.
Figure 7:
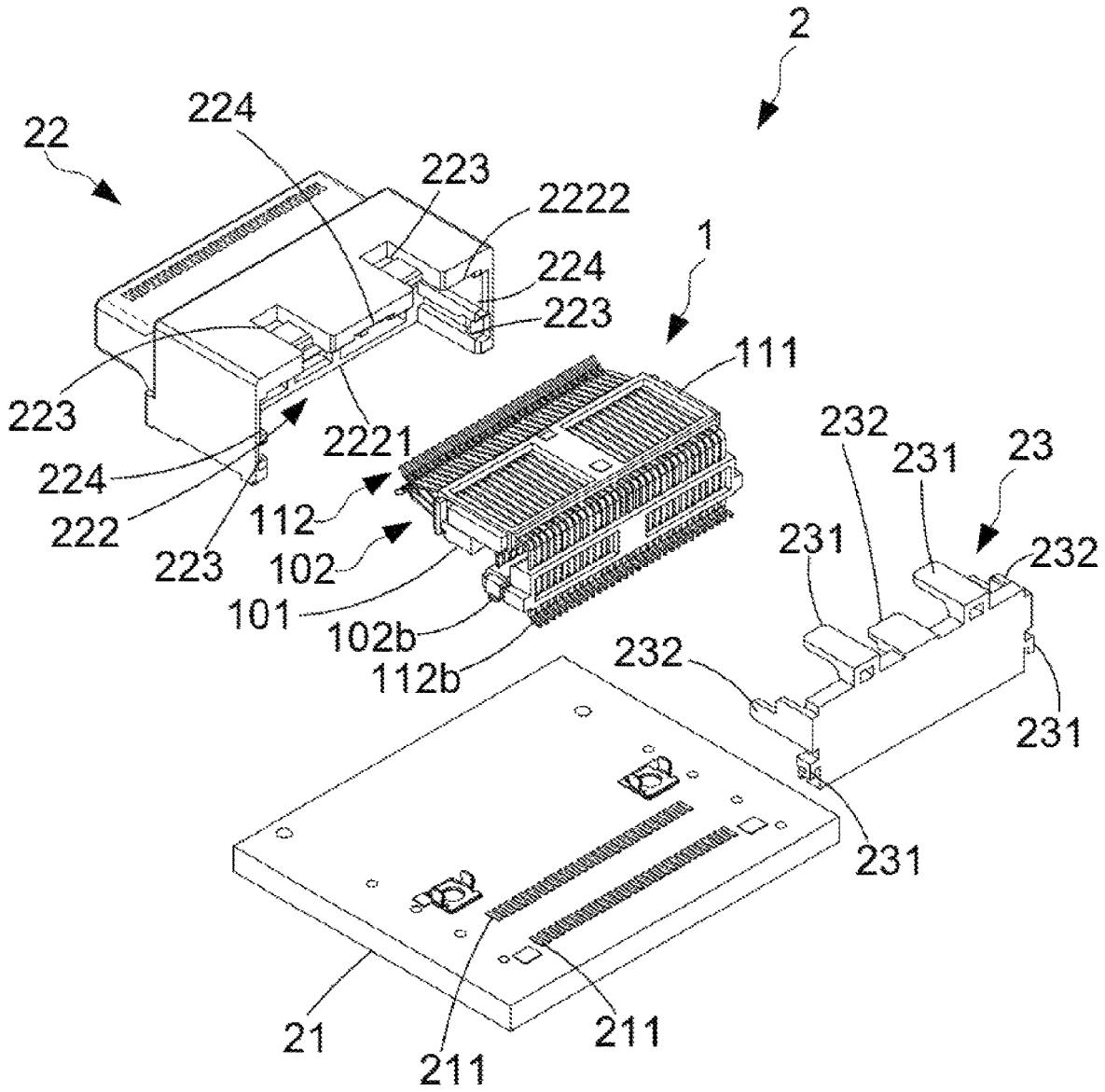
FIG. 7 is an exploded view of the terminal assembly of the second embodiment of the present disclosure.
Figure 8:
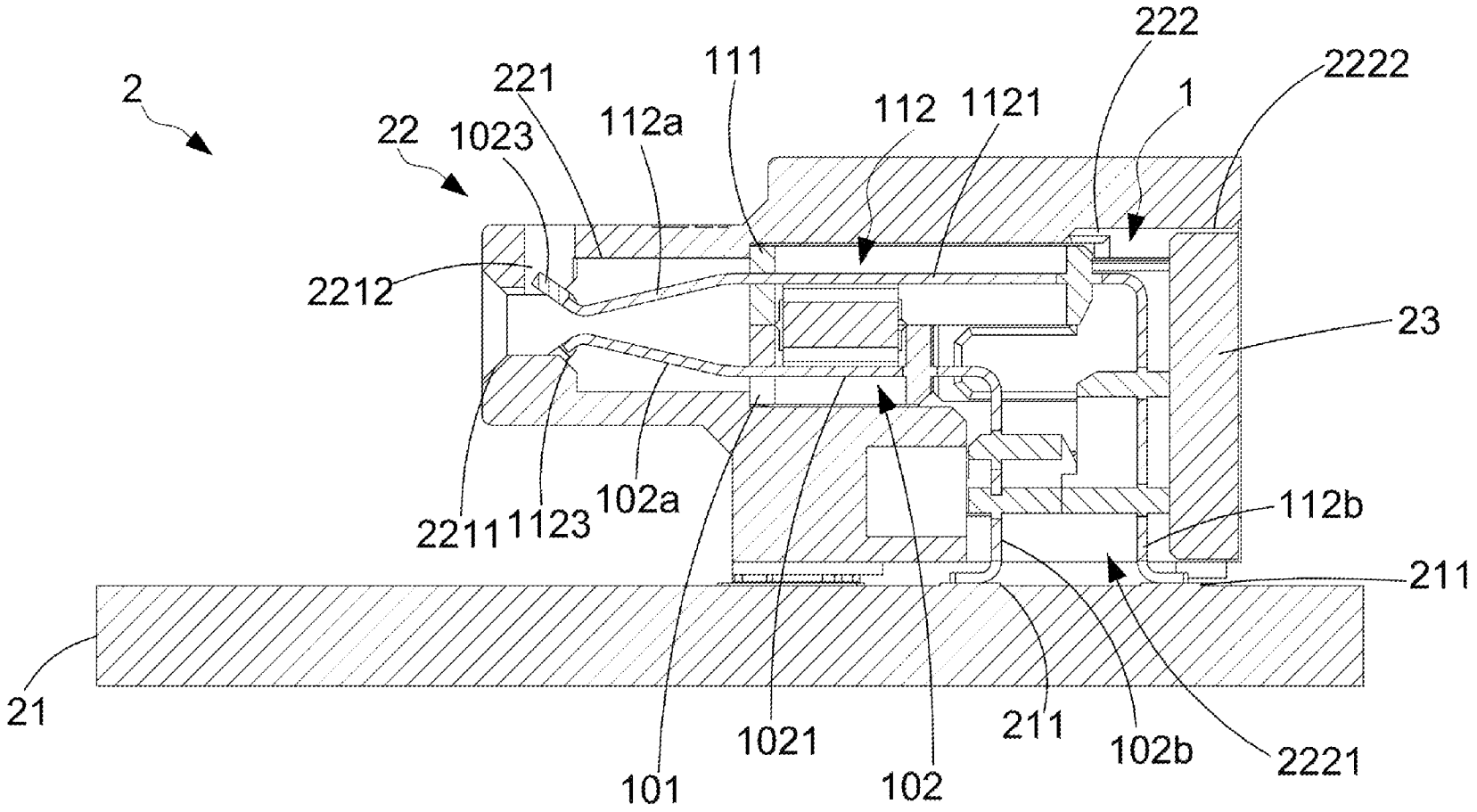
FIG. 8 is a cross-sectional view along line C-C' of FIG. 6.

FIG. 6 and FIG. 7 are perspective view and exploded view of a terminal assembly of the second embodiment of the present disclosure. FIG. 8 is a cross-sectional view along line C-C' of FIG. 6. As shown in the figures, the connector 2 of this embodiment comprises a base 21, a terminal assembly 1 and a housing 22. The terminal assembly 1 of this embodiment applies the terminal assembly of the first embodiment. The terminal assembly 1 is disposed on the base 21 comprising a plurality of contact pads 211. The plurality of first connecting end parts 102*b* of the plurality of first terminals 102 of the terminal assembly 1 and the plurality of second connecting end parts 112*b* of the plurality of second terminals 112 are in contact with the corresponding contact pads 211. The housing 22 is disposed on one side of the base 21 and accommodates the terminal assembly 1. The housing 22 comprises a terminal plug slot 221 and a terminal accommodating slot 222. The terminal plug slot 221 communicates with the terminal accommodating slot 222. The plurality of first plug end parts 102*a* of the plurality of first terminals 102 and the plurality of second plug end parts 112*a* of the plurality of second terminals 112 of the terminal assembly 1 are disposed in the terminal plug slot 221. The first insulating body 101, the second insulating body 111, the plurality of first terminal bodies 1021 of the plurality of first terminals 102 of the terminal assembly 1, the plurality of first connecting end parts 102*b* and the plurality of second terminal bodies 1121 of the plurality of second terminals 112, and the plurality of second connecting end parts 112*b* are disposed in the terminal accommodating slot 222.

The terminal plug slot 221 comprises a plug opening 2211. The plurality of first plug ends 1022*b* of the plurality of first plug end parts 102*a* and the plurality of second plug ends 1122*b* of the plurality of second plug end parts 112*a* are close to the plug opening 2211. The upper sidewall and the lower sidewall of the terminal plug slot 221 are respectively provided with a plurality of terminal positioning slots 2212 disposed at intervals. The plurality of terminal positioning slots 2212 on the upper sidewall of the terminal plug slot 221 respectively corresponds to the plurality of terminal positioning slots 2212 on the lower sidewall of the terminal plug slot 221. The plurality of terminal positioning slots 2212 is close to the plug opening 2211. The plurality of first extension protectors 1023 of the plurality of first terminals 102 is respectively disposed in the plurality of terminal positioning slots 2212 on the lower sidewall of the terminal plug slot 221. The plurality of second extension protectors 1123 of the plurality of second terminals 112 is respectively disposed in the plurality of terminal positioning slots 221 on the upper sidewall of the terminal plug slot 221. In this way, a plurality of first extension protectors 1023 and a plurality of second extension protectors 1123 can be positioned by the plurality of terminal positioning slots 2212. Also, the end parts of the plurality of first extension protectors 1023 and the plurality of second extension protectors 1123 can be prevented from being directly exposed from the plug opening 2211, allowing only the first contacting bumps 1022*c* and the second contacting bumps 1122*c* to be exposed from the plug opening 2211.

The terminal accommodating slot 222 comprises a connection opening 2221 close to the base 21. The plurality of first connecting end parts 102*b* of the plurality of first terminals 102 and the plurality of second connecting end parts 112*b* of the plurality of second terminals 112 pass through the connection opening 2221 and is connected to the base 21. The terminal accommodating slot 222 also comprises a sealing opening 2222 which is opposite to the plug opening 2211. The connector 2 further comprises a sealing member 23 which is disposed in the sealing opening 2222, to secure the terminal assembly 1 in the housing 22. In this way, the terminal assembly 1 can be easily accommodated in the housing 22 through the sealing opening 2222. Then the sealing member 23 can be applied to seal the sealing opening 2222.

The housing 22 comprises a plurality of buckling slots 223, which are respectively disposed on an upper surface of the housing 22 and left and right sidewalls of the terminal accommodating slot 222, and are disposed on the circumference of the sealing opening 2222. The sealing member 23 comprises a plurality of buckling parts 231, which are disposed on the upper side, left side, and right side of the sealing member 23. Each of the buckling parts 231 is buckled with the corresponding buckling slots 223 to be secured onto the housing 22. The housing 22 also comprises a plurality of aligning slots 224, which are respectively disposed on the upper sidewall, left side wall, and right side wall of the terminal accommodating slot 222, and are disposed on the circumference of the sealing opening 2222. The sealing member 23 also comprises a plurality of aligning parts 232, which are disposed on the upper side, left side, and right side of the sealing member 23. Each of the aligning parts 232 is disposed in the corresponding aligning slot 224, which pre-positions the sealing member 23 on the housing 22 so that each of the buckling parts 231 can be buckled in the corresponding buckling slot 223 without obstruction.

In summary, embodiments of the present disclosure provide a terminal assembly and a connector, which improve the SI performance of the connector by shortening the first plug end of the first plug elastic sheet and the second plug end of the second plug elastic sheet of a metal conductor. Meanwhile, a first extension protector as an insulator provided on the first plug end of the first plug elastic sheet and a second extension protector provided on the second plug end of the second plug elastic sheet respectively protect the first plug end and the second plug end to prevent the first plug end and the second plug end from being compressed to deform when the plugging. In this way, the structural strength of the first terminal and the second terminal can be effectively enhanced.

It is to be understood that the term "comprises", "comprising", or any other variants thereof, is intended to encompass a non-exclusive inclusion, such that a process, method, article, or device of a series of elements not only comprise those elements but also comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. A terminal assembly, comprising:

a first terminal component comprising a plurality of first terminals, each of the first terminals comprising a first terminal body and a first plug end part disposed on one end of the first terminal body, the first plug end part comprising a first plug elastic sheet and a first extension protector, the first plug elastic sheet comprising a first plug end, a first connecting end and a first contacting bump, the first connecting end being connected to the first terminal body, the first contacting bump being disposed between the first plug end and the first connecting end, the first extension protector being disposed on the first plug end of the first plug elastic sheet; and a second terminal component disposed on one side of the first terminal component, the second terminal component comprising a plurality of second terminals, each of the second terminals comprising a second terminal body and a second plug end part disposed on one end of the second terminal body, the second plug end part being opposite to the first plug end part, the second plug end part comprising a second plug elastic sheet and a second extension protector, the second plug elastic sheet comprising a second plug end, a second connecting end and a second contacting bump, the second connecting end being connected to the second terminal body, the second contacting bump being disposed between the second plug end and the second connecting end, the second contacting bump being opposite to the first contacting bump, the second extension protector being disposed on the second plug end;

wherein the first plug elastic sheet between the first connecting end and the first contacting bump extends in a direction closing to the second plug end; the first extension protector extends in a direction away from the second plug end part; the second plug elastic sheet between the second connecting end and the second contacting bump extends in a direction closing to the first plug end part; the second extension protector extends in a direction away from the first plug end part.

2. The terminal assembly according to claim 1, wherein a vertical gap exists between the first plug end and the first connecting end; a vertical gap exists between the second plug end and the second connecting end; a second vertical gap exists between one end of the first extension protector away from the first plug end and the first connecting end; a second vertical gap exists between one end of the second extension protector away from the second plug end and the second connecting end; the first vertical gap is greater than the second vertical gap.

3. The terminal assembly according to claim 1, wherein the first extension protector covers the first plug end; the second extension protector covers the second plug end.

4. The terminal assembly according to claim 3, wherein the thickness and width of the first extension protector are greater than the thickness and width of the first plug end; the thickness and width of the second extension protector are greater than the thickness and width of the second plug end.

5. The terminal assembly according to claim 1, wherein the first plug elastic sheet between the first contacting bump and the first plug end extends in a direction away from the second plug end part; the second plug elastic sheet between the second contacting bump and the second plug end extends in a direction away from the first plug end part.

6. The terminal assembly according to claim 1, wherein the first extension protector and the second extension protector are insulators.

7. The terminal assembly according to claim 1, wherein each of the first terminals further comprises a first connecting end part disposed on the other end of the first terminal body; each of the second terminals further comprises a second connecting end part disposed on the other end of the second terminal body; the second connecting end part is opposite to the first connecting end part.

8. The terminal assembly according to claim 7, wherein each of the first terminal assemblies further comprises a first insulating body disposed on one side of the first terminal body; each of the second terminal assemblies further comprises a second insulating body disposed on the second terminal body; the second insulating body is connected to the first insulating body.

9. The terminal assembly according to claim 8, wherein the extending direction of the first connecting end part is orthogonal to the extending direction of the first plug end part; the extending direction of the second connecting end part is orthogonal to the extending direction of the second plug end part.

10. The terminal assembly according to claim 9, wherein the first terminal body comprises a first body end part and a second body end part; the first body end part is connected to the second body end part; the first body end part is orthogonal to the second body end part; the first plug end part is connected to the first body end part; the first connecting end part is connected to the second body end part; the second terminal body comprises a third body end part and a fourth body end part; the third body end part is connected to the fourth body end part; the third body end part is orthogonal to the fourth body end part; the second plug end part is connected to the third body end part; the second connecting end part is connected to the fourth body end part.

11. The terminal assembly according to claim 10, wherein the first insulating body comprises a first insulator and a second insulator; the first insulator is disposed on one side of the first body end part; the second insulator is disposed on one side of the second body end part; the second insulating body comprises a third insulator and a fourth insulator; the third insulator is disposed on one side of the third body end part; the fourth insulator is disposed on one side of the fourth body end part; the third insulator is connected to the first insulator; the fourth insulator abuts against the second insulator.

12. The terminal assembly according to claim 11, wherein the first insulator comprises a first buckling member on two sides; the third insulator comprises a second buckling member on two sides; the second buckling member is buckled with the first buckling member.

13. A terminal assembly, comprising:

a first terminal component comprising a plurality of first terminals, each of the first terminals comprising a first terminal body and a first plug end part disposed on one end of the first terminal body, the first plug end part comprising a first plug elastic sheet and a first extension protector, the first plug elastic sheet comprising a first plug end, a first connecting end and a first contacting bump, the first connecting end being connected to the first terminal body, the first contacting bump being disposed between the first plug end and the first connecting end, the first extension protector being an insulator;

wherein the first extension protector is disposed on the first plug end of the first plug elastic sheet.

14. A connector, comprising:

a base;

a housing disposed on one side of the base, comprising a terminal plug slot and a terminal accommodating slot communicating with the terminal plug slot, the terminal plug slot comprising a plug opening and a plurality of terminal positioning slots disposed on an upper sidewall and a lower sidewall of the terminal plug slot, the plurality of terminal positioning slots being close to the plug opening; and a first terminal component according to claim 1 being disposed in the terminal plug slot and the terminal accommodating slot, each of the first plug end parts and each of the second plug end parts being disposed in the terminal plug slot, each of the first extension protectors and each of the second extension protectors being disposed in the plurality of terminal positioning slots.

15. The connector according to claim 14, wherein the terminal accommodating slot further comprises a sealing opening opposite to the plug opening; the connector further comprises a sealing member disposed on the sealing opening.

16. The connector according to claim 15, wherein the housing comprises a plurality of buckling slots disposed on the circumference of the sealing opening; a plurality of buckling parts is provided on a side of the sealing member; each of the bucking parts buckles with the corresponding buckling slot.

17. The connector according to claim 15, wherein the housing comprises a plurality of aligning slots disposed on the circumference of the sealing opening; a plurality of aligning parts is provided on a side of the sealing member; each of the aligning parts is disposed in the corresponding aligning slot.

* * * * *